US006910850B2

(12) United States Patent
Nonaka et al.

(10) Patent No.: US 6,910,850 B2
(45) Date of Patent: Jun. 28, 2005

(54) VACUUM PUMP

(75) Inventors: Manabu Nonaka, Narashino (JP); Takashi Kabasawa, Narashino (JP)

(73) Assignee: BOC Edwards Technologies, Limited, Narashino (JP)

( * ) Notice: Subject to any disclaimer, the term of this patent is extended or adjusted under 35 U.S.C. 154(b) by 88 days.

(21) Appl. No.: 10/315,636

(22) Filed: Dec. 10, 2002

(65) Prior Publication Data

US 2003/0129053 A1 Jul. 10, 2003

(30) Foreign Application Priority Data

Dec. 13, 2001 (JP) ..... 2001-380490

(51) Int. Cl.[7] ..... F01D 1/36
(52) U.S. Cl. ..... 415/90; 415/116
(58) Field of Search ..... 415/90, 115–116, 415/180, 175; 417/251, 307, 520, 373, 423.4

(56) References Cited

U.S. PATENT DOCUMENTS 5,165,872 A 11/1992 Fleischmann et al. ... 417/423.4
5,924,841 A * 7/1999 Okamura et al. ..... 415/90
6,290,457 B1 * 9/2001 Kabasawa et al. ..... 415/90
6,382,249 B1 * 5/2002 Kawasaki et al. ..... 137/565.3

FOREIGN PATENT DOCUMENTS

EP 0887556 12/1988
EP 1030062 8/2000

* cited by examiner

*Primary Examiner*—F. Daniel Lopez
*Assistant Examiner*—James M. McAleenan
(74) *Attorney, Agent, or Firm*—Adams & Wilks

(57) ABSTRACT

A vacuum pump has a pump case having a gas suction port at an upper part of the pump case and a gas exhaust port at a lower part of the pump case. A stator column extends from a base of the pump case and has an outer circumferential surface. A rotor shaft is rotatably supported in the pump case by the stator column. A spacer is removably integrally connected to the outer circumferential surface of the stator column. The spacer has an outer circumferential surface spaced apart from an inner circumferential surface of the rotor and a through-hole extending form the outer circumferential surface to an inner circumferential surface thereof. A connecting member extends through the through-hole of the spacer and contacts the outer circumferential surface of the stator column to thereby removably integrally connect the spacer to the outer circumferential surface of the stator column.

22 Claims, 7 Drawing Sheets

PRIOR ART

PRIOR ART

VACUUM PUMP

BACKGROUND OF THE INVENTION

1. Field of the Invention

The present invention relates to a vacuum pump used in an apparatus such as a semiconductor manufacturing apparatus, an electron microscope, a surface analysis apparatus, a mass spectrograph, a particle accelerator, and a nuclear fusion experiment apparatus, and, more particularly, to the structure of an inexpensive vacuum pump which has a large pumping capacity and can be handled easily.

2. Description of the Related Art

In a process such as dry etching, chemical vapor deposition (CVD), or the like performed in a high-vacuum process chamber in a semiconductor manufacturing step, a vacuum pump such as a turbo-molecular pump is used of producing a degree of high vacuum in the process chamber by exhausting gas from the process chamber.

As shown in FIG. 6, in the conventional turbo-molecular pump P6, a plurality of rotor blades 17 are provided on the outer wall of a cylindrical the rotor 16, a plurality of stator blades 18, which are positioned and fixed between rotors 17, are fixed on the inner wall of the pump case 11, and the rotor 16 is integrally secured to the rotor shaft 15.

The process chamber connected to a gas suction port 12 at the top of the pump case 11 is in a high vacuum state. By driving a drive motor 19 so as to rotate the rotor shaft 15 at high speed, gas taken in from the gas suction port 12 is fed to a thread groove pump mechanism portion as the lower stage of the turbo molecular pump by the interaction between the rotor blades 17, rotating at high speed together with the rotor shaft 15, and the stator blades 18, compressed from an intermediate flow state to a viscous flow stated by the interaction between the cylindrical surface of the outer wall of the rotor 16 and thread grooves 21 on the inner wall of a threaded stator 20, and then discharged from a gas exhaust port 13 as the final stage of the turbo molecular pump P6. During this operation, since the temperature of the rotation body composed of the rotor 16 and the rotor blades 17 is increased by the heat of gas compression, it is necessary to cool the rotation body by dissipating the heat in the rotation body to stationary components in the pump case 11.

Heat radiation and heat transfer are well known as means for dissipating the heat in the rotation body. The former is performed by means (a) which radiates the heat from the rotor blades 17 to the stator blades 18, and the latter is performed by means (b) which transfers the heat by conduction via gas or means (c) which transfers the heat by conduction via bearings. However, as shown in FIG. 6, in the turbo molecular pump P6 in which the rotor shaft 15 is supported in a non-contacting manner by magnetic bearings composed of radial electromagnets 22 and axial electromagnets 23, since the rotor shaft 15 does not come into contact with protection ball bearings 24 during normal operation of the turbo molecular pump P6, the heat dissipation is not realized by the direct heat transfer via bearings of the means (c) but achieved by the heat radiation and the heat transfer via gas of the means (a) and (b), respectively. Further, when an amount of gas flowing in the pump case 11 is small or a low-thermal-conductivity gas such as Ar gas is pumped, the heat transfer via gas of the means (b) cannot be expected. Thus, only the heat radiation of the means (a) is dependable means for dissipating the heat, thereby resulting in poor heat-dissipation efficiency and accordingly causing the heat of compression of the gas pumped by the turbine to be likely stored in the rotor blades 17.

To solve this problem, as shown in FIG. 6, so far the rotating cylindrical body composed of the rotor 16 and the rotor blades 17 has been cooled by feeding a high-thermal-conductivity purging gas such as nitrogen gas (i.e., $N_2$ gas) into the pump case 11 from the outside. More particularly, as FIG. 6 shows the flows of the vacuum-pumping gas and the purging gas indicated by the dotted and solid arrow lines, respectively, the purging gas flows along a passage R, which is in communication with the gap between the outer wall of the rotor shaft 15 and the inner wall of a stator column 14 and with the other gap between the outer wall of the stator column 14 and the inner wall of the rotor 16, and exits from the gas exhaust port 13, thereby the heat of gas compression stored in the rotor 16 being dissipated from the inner wall of the rotor 16 to the outer wall of the stator column 14.

According to this method, in order to improve the cooling effect, a gap g1 between the inner wall of the rotor 16 and the outer wall of the stator column 14 is required to be as small as possible. That is because, if the gap g1 is large, a thermal boundary layer is produced in a viscous flow region, thereby lowering the thermal conductivity of the purge gas between the inner wall of the rotor 16 and the outer wall of the stator column 14, and also if the gap g1 becomes larger than an average free path of gas molecules in a molecular flow region, the probability in which the gas molecules released from the surface of the rotor 16 directly reaches the surface of the stator column 14 becomes lower, thereby lowering the thermal conductivity of the purge gas in the same fashion as described above.

However, as shown in FIG. 7, in a turbo molecular pump P7 in which, when a rotor 16-1 having rotor blades 17-1 having a larger diameter L7 than the rotor blades 17 having a diameter L6 shown in FIG. 6 is mounted on the rotor shaft 15 shown in FIG. 6 so as to pump a larger amount of gas, the rotor 16-1 and the stator column 14 have a very large gap g2 between the inner wall of the rotor 16-1 and the outer wall of the stator column 14, compared to the small gap g1 shown in FIG. 6 between the inner wall of the rotor 16 and the outer wall of the stator column 14. Since such a large gap g2 causes the purging gas to have a dramatically lowered thermal conductivity as described above, it is required to make the gap g2 smaller down to the predetermined gap g1 by forming the outer-wall shape of the stator column 14 based on the inner-wall shape of the rotor 16-1 so as to achieve a desired thermal conductivity of the purging gas.

As a method for making the gap g2 smaller, forming the rotor 16-1 so as to have a thick lower part when manufacturing is considered. However, the thicker the lower part, the higher the cost of the rotor 16-1 becomes. In addition, since the rotor 16-1 is a high-speed rotating component during operation of the turbo molecular pump, the thicker lower part leads to the heavier rotor 16-1, and thus the turbo molecular pump requires a larger power for its operation, thereby resulting in a deteriorated compression performance and likely causing the rotation body to rotate in an unbalanced state.

As another method for making the gap g2 smaller, forming the stator column 14 so as to have an outer-wall shape based on the inner-wall shape of the rotor 16-1 is considered. However, in this case, several types of the stator columns 14, having different outer-wall shapes and accommodating expensive electrical components and the like therein, must be prepared and disposed in the pump case 11 depending on the inner-wall shape of the rotor, thereby causing a dramatic cost increase in manufacturing the turbo molecular pump.

The present invention has been made in view of the above-described problems. Accordingly, it is an object of the present invention to provide a vacuum pump in which, when a rotor having a large diameter is mounted so as to pump a large amount of gas, a small gap is easily formed, with a small amount of additional cost, between the inner wall of the rotor and the outer wall of a stator column, and which achieves a dramatic cost reduction in manufacturing the vacuum pump compared to the manufacturing cost of the conventional vacuum pump.

SUMMARY OF THE INVENTION

To achieve the above-described object, a vacuum pump according to the present invention comprises a rotor shaft rotatably supported in a pump case having a gas suction port at the top thereof and a gas exhaust port at a part of the lower side wall thereof; a drive motor for rotating the rotor shaft; a stator column accommodating the rotor shaft and the drive motor and provided in the pump case so as to be erected; a rotor surrounding the stator column and fixed to the rotor shaft; and a spacer having an outer-wall shape based on the inner-wall shape of the rotor-and detachably fixed to the peripheral outer surface of the stator column.

In the vacuum pump according to the present invention, the spacer may fill in the gap between the stator column and the rotor so as to provide a predetermined small gap between the outer wall surface of the spacer and the inner wall surface of the rotor.

Also, in the vacuum pump according to the present invention, the spacer may be composed of a high-thermal-conductivity metal material.

In the vacuum pump according to the present invention, the fixing structure between the stator column and the spacer may be adopted the construction in which a part of the outer wall of the spacer is cut out so as to form a flange and the spacer is fixed to the stator column by clamping the flange.

Further, the fixing structure between the stator column and the spacer may be adopted the construction in which the spacer is fixed to the stator column by fastening a setscrew screwed from the outer wall to the inner wall of the spacer.

Furthermore, the fixing structure between the stator column and the spacer may be adopted the construction in which the spacer is fixed to the stator column by fastening through a fixing hole provided in the stator column in the axial direction of the rotor shaft.

The vacuum pump according to the present invention may have a turbo-molecular pump mechanism portion wherein a plurality of rotor blades are integrally formed on the outer wall of the rotor and a plurality of stator blades are integrally formed on the outer wall of the rotor. The rotor blades and the stator blades are alternately disposed in the pump case.

According to the present invention, the vacuum pump has a structure in which a spacer having an outer-wall shape based on the inner-wall shape of the rotor and detachably fixed to the outer circumferential surface of the stator column. With this structure, even when the vacuum pump is required to pump a large amount of gas, and thus the rotor having the large-diameter rotor blades is mounted on the stator so as to form a small predetermined gap between the inner wall of the rotor and the outer wall of the stator column, the rotor is not required to have a thick part, or the expensive stator column is not required to be manufactured depending on the size of the gap, but to exchange the spacer only, thereby leading to a dramatic reduction in manufacturing cost of the vacuum pump.

DETAILED DESCRIPTION OF THE PREFERRED EMBODIMENTS

Preferred embodiments of a vacuum pump according to the present invention will be described in detail with reference to the accompanying drawings.

Figure 1:
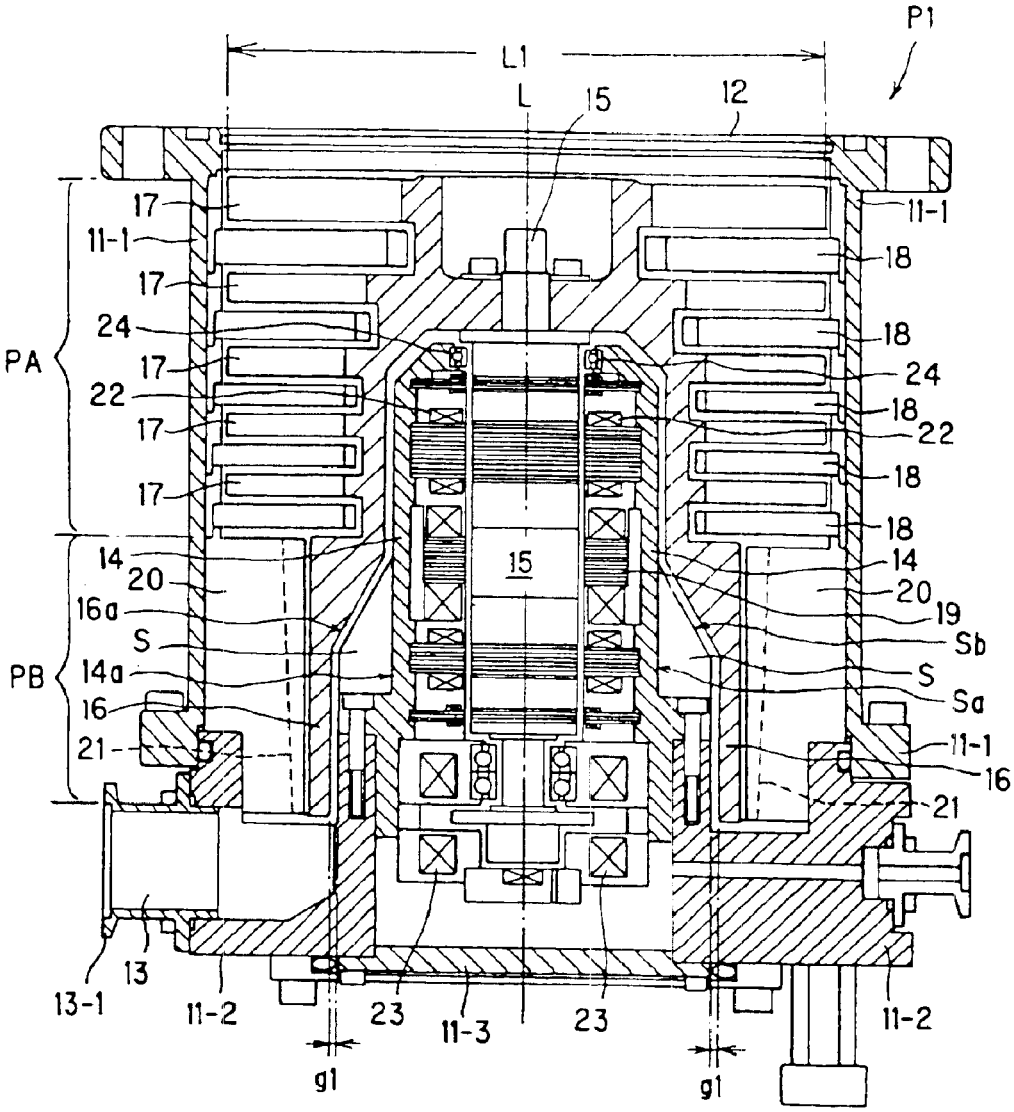
FIG. 1 is a vertical sectional view illustrating the entire structure of a vacuum pump according to the present invention.

FIG. 1 is a vertical sectional view illustrating the entire structure of a vacuum pump P1 according to the present invention. As shown in the figure, the vacuum pump P1 has a composite type pump mechanism formed by a turbo molecular pump mechanism portion PA and a thread groove pump mechanism portion PB, both being accommodated in a pump case 11.

The pump case 11 is composed of a cylindrical portion 11-1 and a base member 11-2 mounted at the lower end thereof. The upper surface of the pump case 11 is opened and serves as a gas suction port 12. To the gas suction port 12, a vacuum vessel such as a process chamber (not shown) is fixed to a flange of the pump case 11 with a screw. The lower side surface of the pump case 11 has a gas exhaust port 13, to which a gas exhaust pipe 23 is mounted.

The lower bottom of the pump case 11 is covered with a bottom cover 11-3, above which a stator column 14 being provided so as to be erected toward the inside of the pump case 11 is fastened to the base member 11-2. The stator column 14 has a rotor shaft 15, which passes through the end faces of the stator column and is rotatably journaled by radial electromagnets 22 and axial electromagnets 23, both serving as magnetic bearings, which are provided in the stator column 14, in the radial and axial directions of the rotor shaft 15. A ball bearing 17 coated with a dry lubricant prevents the contact between the rotor shaft 15 and the electromagnets 22 and 23 to support the rotor shaft 15 at the power failure of a magnetic bearing composed of the radial electromagnet 22 and the axial electromagnet 23, being in non-contact with the rotor shaft 15 in normal operation.

In the pump case 11, a rotor 16 is disposed so as to surround the stator column 14. The top end of the rotor 16 extends upwards close to the gas suction port 12 and the rotor 16 is fixed to the rotor shaft 15 with screws in the axial direction L of the rotor shaft 15. A drive motor 19 such as a high-frequency motor disposed between the rotor shaft 15 and the stator column 14 in the substantially central part of the rotor shaft 15 with respect to the axial direction L so that the drive motor 19 drives the rotor shaft 15 and the rotor 16 to rotate at high speed.

In addition, the rotor 16 has a plurality of rotor blades 17 integrally formed therewith on the upper outer wall thereof such that the blades 17 are disposed starting from the vicinity of the gas suction port 12 and coming down along the axial direction L. The cylindrical portion 11-1 in the pump case 11 has a plurality of stator blades 18 fixed to the inner wall thereof such that the rotor blades 17 and the stator blades 18 are alternately disposed. This structure forms the turbo molecular pump mechanism PA in which gas molecules from the gas suction port 12 are fed into the lower stage of the pump mechanism PA by the interaction between the high-speed rotating rotor blades 17 and the stationary stator blades 18.

The lower outer wall of the rotor 16 is a smooth cylindrical surface. The base 11-2 in the pump case 11 has a cylindrical threaded stator 20 fixed thereto and opposing the cylindrical surface of the lower outer wall of the rotor 16 with a small gap therebetween. The threaded stator 20 has a plurality of thread grooves 21, indicated by a dotted line in the figure, formed on the inner surface thereof. This structure forms the thread groove pump mechanism portion PB in which the gas molecules fed from the turbo molecular pump mechanism PA are compressed from an intermediate flow state to a viscous flow state by the interaction between the cylindrical surface of the lower outer wall of the rotor 16 rotating at high-speed and the thread grooves 21 on the inner wall of the stationary threaded stator 20 and then are exhausted from the gas exhaust port 13 in the subsequent stage of the pump mechanism PB.

A spacer S is provided between the lower inner wall of the rotor 16 and the outer wall of the stator column 14 opposing thereto, spacer which has an outer-wall shape Sb based on an inner-wall shape 16*a* of the rotor 16. The spacer S is preferably composed of a high-thermal-conductivity metal material. Accordingly, the spacer S is formed by machining a light metal, such as an aluminum alloy, which is a relatively soft metal and is easily processed, and further has a relatively large specific tensile strength, or an iron-base metal, such as a stainless steel or a nickel steel, into a predetermined shape and then is detachably fixed to the peripheral outer surface of the stator column 14. Although various types of detachable fixing structures between the spacer S and the stator column 14 are considered, for example, those shown in FIGS. 2 to 4 may be adopted.

Figure 2A:
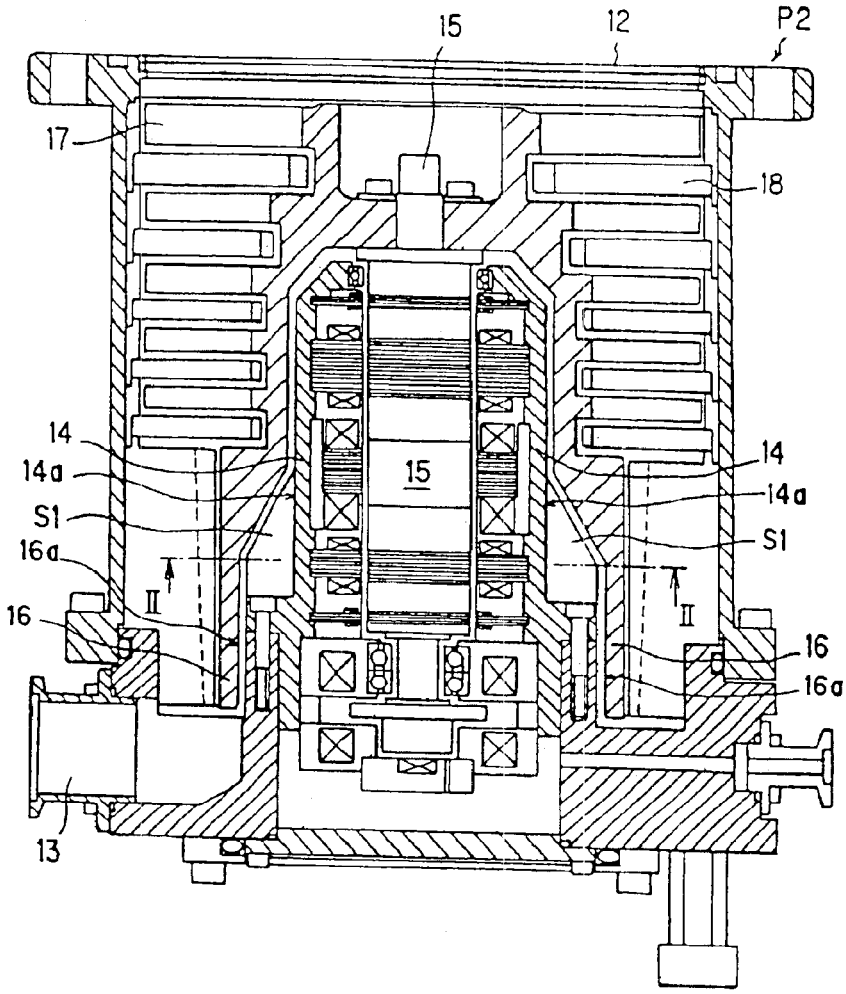
FIGS. 2(*a*) and 2(*b*) illustrate a first embodiment of a spacer fixing structure wherein FIG. 2(*a*) is a vertical sectional view of the vacuum pump and FIG. 2(*b*) is a cross-sectional view taken along the line II—II indicated in FIG. 2(*a*)
Figure 2B:
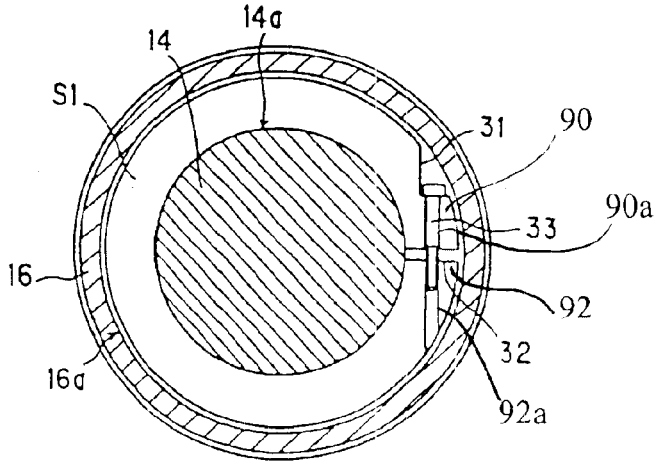

The fixing structure of a spacer S1 in a vacuum pump P1 shown in FIG. 2 is adopted as a structure in which a part of the outer wall of the spacer S1 is cut out so as to form a flange 31 and the spacer S1 is fixed to the stator column 14 by clamping the flange 31 with a connecting member such as a bolt 33. More particularly, as shown in FIG. 2(*b*), the spacer S1 is generally ring-shaped and has a clamping structure. In order to have an inner diameter conforming to an outer circumferential surface or outer-wall shape 14*a* of the stator column 14 and also an outer diameter conforming to the inner-wall shape 16*a* of the rotor 16, a radial cut or pass-through groove 32 is formed at a part the spacer S1 from the outer wall to the inner wall (e.g., outer and inner circumferential surfaces) thereof to define a pair of arm portions 90, 92 having aligned through-holes 90*a*, 90*a*, respectively, which are aligned with one another. The flange 31 is formed by cutting out a part of the outer wall of the spacer S1 in the vicinity of the pass-through groove 32 so as to have an L-sectional shape. The spacer S1 is clamped to the stator column 14 by inserting the bolt 33 through the through-hole 90*a*, 90*a* of the arm portion 90, 92, respectively, from the flange 31 so that the bolt 33 extends orthogonal to the pass-through groove 32. In this manner, the spacer S1 is tightened and thereby removably integrally connected to the outer circumferential surface of the stator column 14.

Figure 3A:
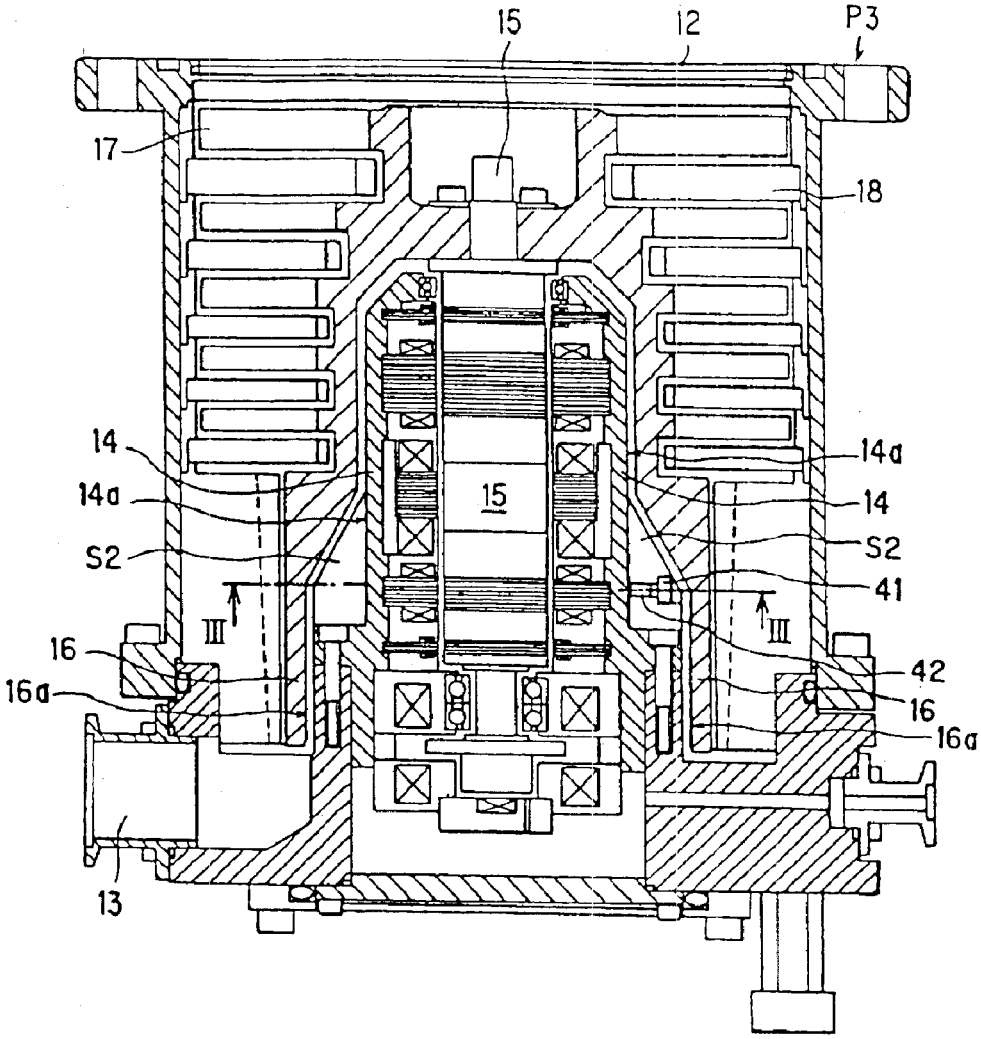
FIGS. 3(*a*) and 3(*b*) illustrate a second embodiment of a spacer fixing structure wherein FIG. 3(*a*) is a vertical sectional view of the vacuum pump and FIG. 3(*b*) is a cross-sectional view taken along the line III—III indicated in FIG. 3(*a*)
Figure 3B:
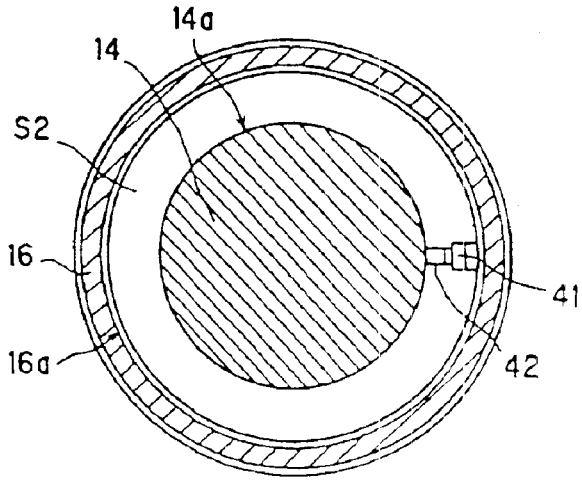

The fixing structure of a spacer S1 in a vacuum pump P3 shown in FIG. 3 is adopted as a structure in which the spacer S2 is fixed to the stator column 14 by fastening a connecting member or setscrew 41 screwed from the outer wall to the inner wall thereof. More particularly, as shown in FIG. 3(*b*), in this fixing structure that is a fastening structure, in order to have an inner diameter based on an outer-wall shape 14*a* of the stator column 14 and also an outer diameter based on the inner-wall shape 16*a* of the rotor 16, a threaded hole 42 is formed in a part thereof so as to extend from the outer wall to the inner wall of the cylindrical spacer S2 having ring-shape cross section, and thus the spacer S2 is fastened to the stator column 14 from the side surface thereof with the setscrew 41 inserted through the threaded hole 42 so that the setscrew 41 contacts the outer circumferential surface of the stator column 14.

Figure 4:
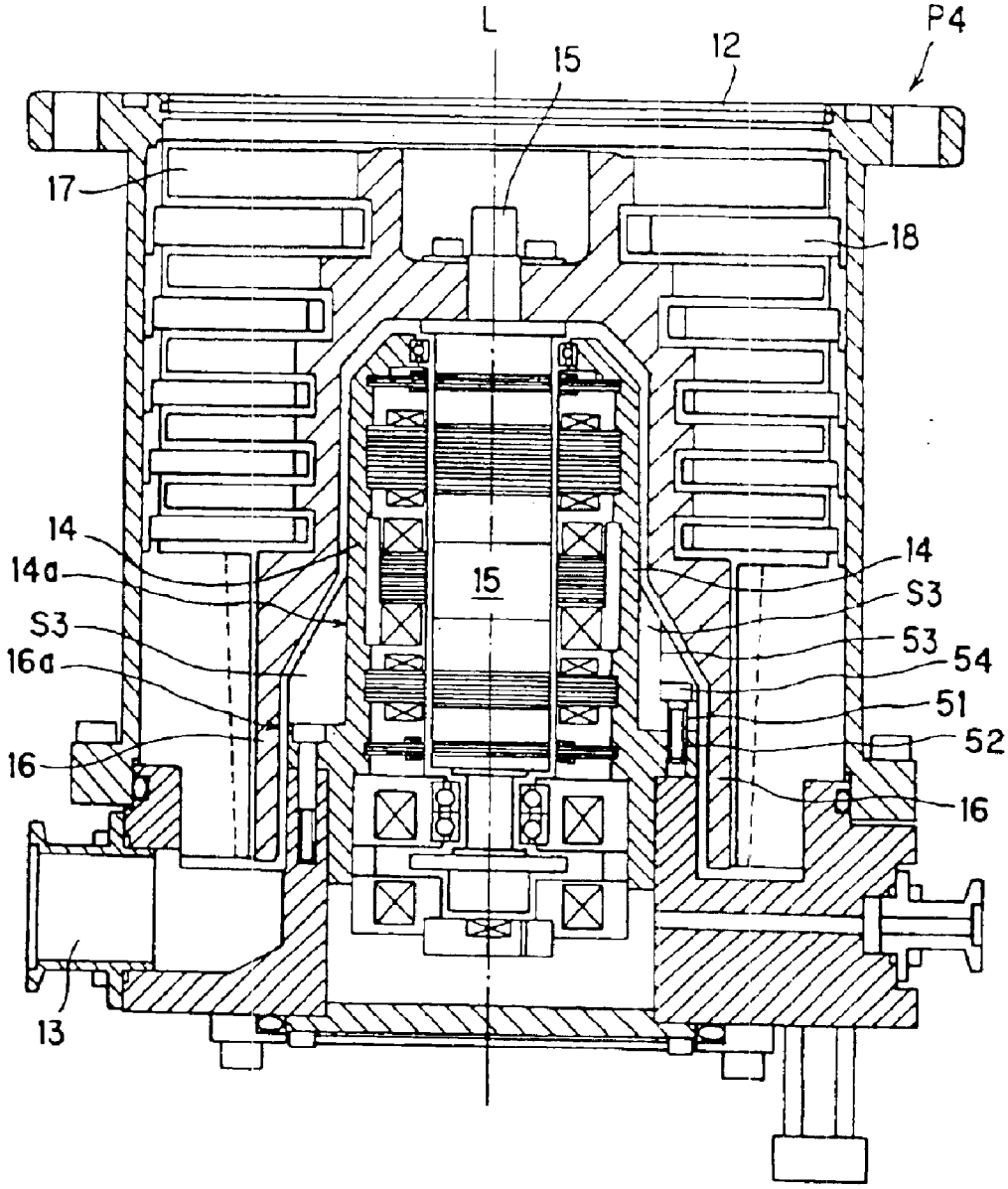
FIG. 4 is a vertical sectional view illustrating a third embodiment of a spacer fixing structure of the vacuum pump shown in FIG. 1.

The fixing structure of the spacer S3 in a vacuum pump P4 shown in FIG. 4 is adopted as a structure in which the spacer S3 is fixed to the stator column 14 by fastening a bolt 54 placed in a fixing hole 52 provided in the stator column 14 in the axial direction L of the rotor shaft 15. More particularly, in this fixing structure, in order to have an inner diameter based on the outer-wall shape 14*a* of the stator column 14 and also an outer diameter based on the inner-wall shape 16*a* of the rotor 16, a fixing step portion 53 is formed on a part of the outer wall of the spacer S3 having a ring-shape cross section so as to have an L-sectional shape, a fixing through-hole 51 is formed in the fixing step 53 portion in the axial direction L of the rotor shaft 15, the fixing hole 52 is formed in the stator column 14 so as to agree with the fixing through-hole 51, and thus the spacer S3 is fastened to the stator column 14 in the axial direction L of the rotor shaft 15 with the bolt 54 inserted and screwed through the fixing through-holes 51 and 52 in this order.

With these fixing structures shown in FIGS. 2 to 4, the cylindrical spacers S1 to S3 disposed around the outer circumferential surface of the cylindrical stator column 14 are firmly fixed to the stator column 14. In addition, the spacers S1, S2, and S3 are easily detached from the stator column 14 only by unfastening the bolt 33, the setscrew 41, and the bolt 54, respectively.

Figure 5:
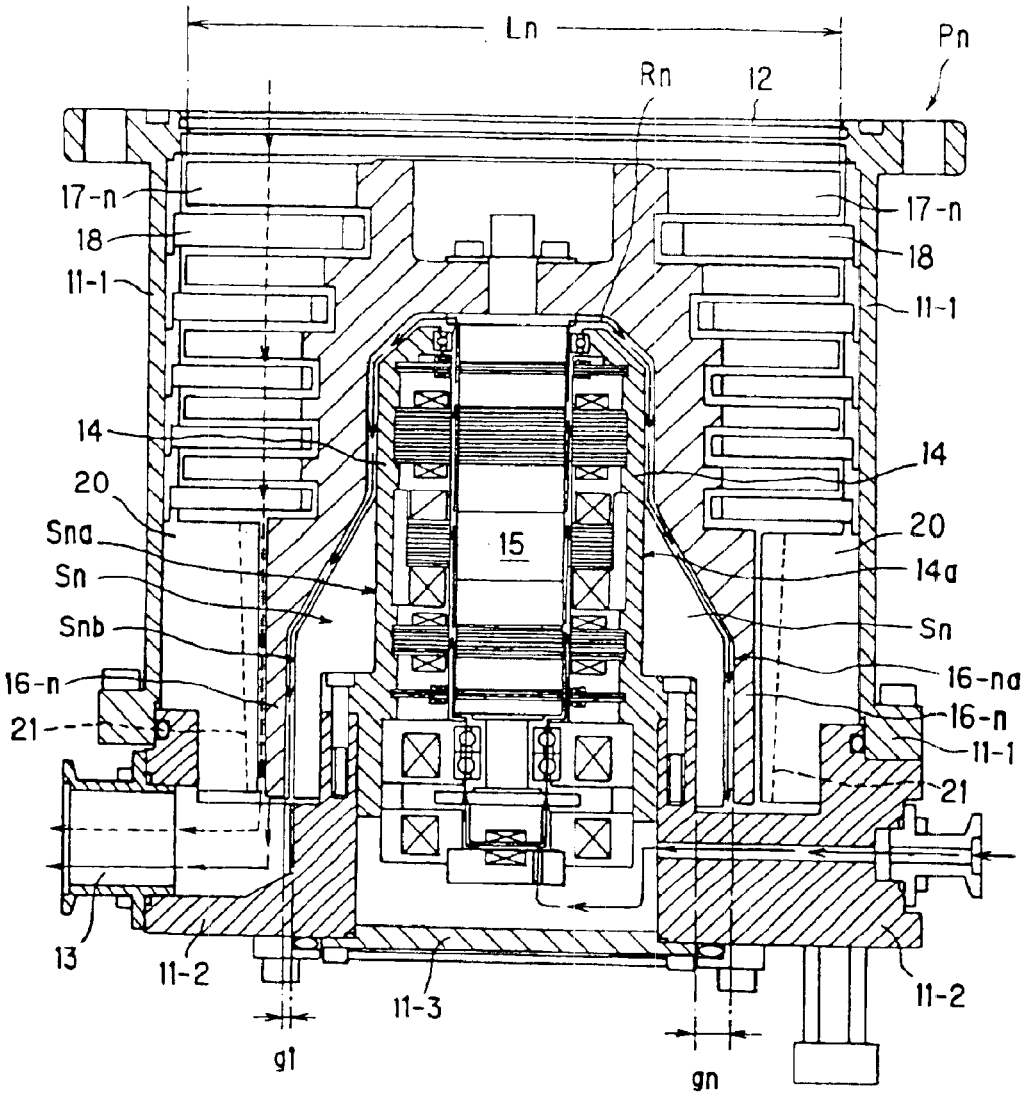
FIG. 5 is a vertical sectional view of the vacuum pump according to the present invention, having large-diameter rotor blades disposed therein.
Figure 6:
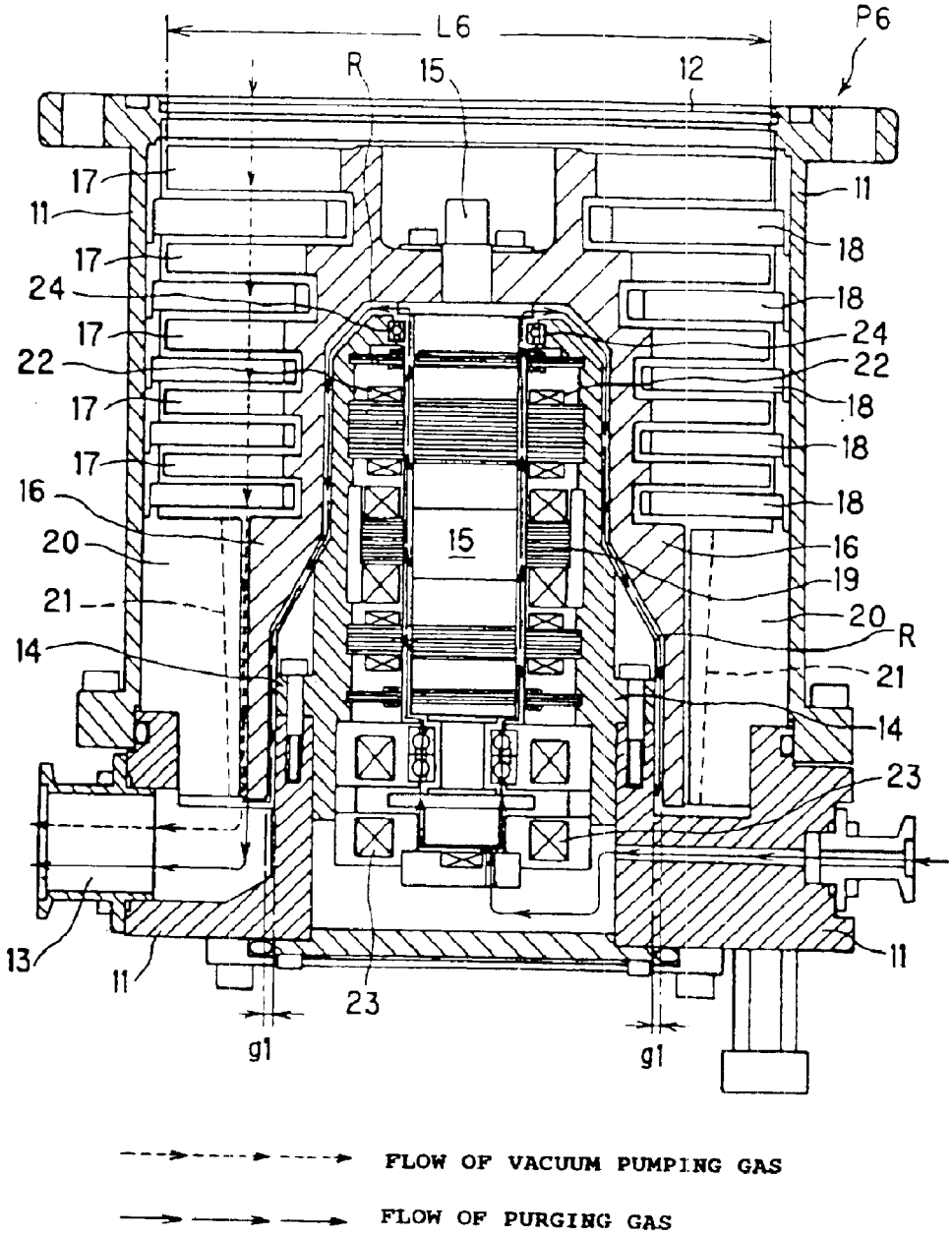
FIG. 6 is a vertical sectional view illustrating the entire structure of a conventional vacuum pump.
Figure 7:
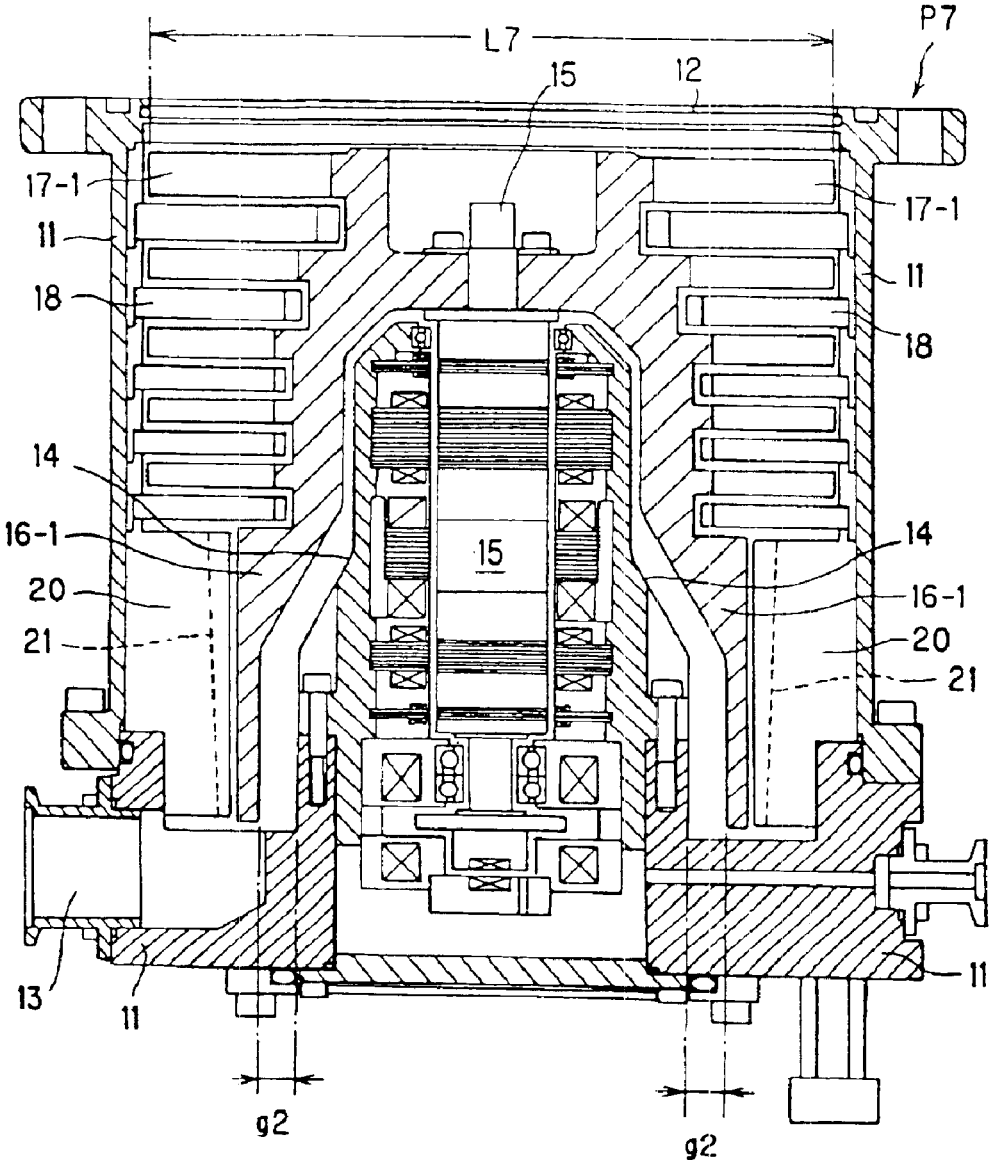
FIG. 7 is a vertical sectional view illustrating disadvantages of the conventional vacuum pump, shown in FIG. 6, having large-diameter rotor blades disposed therein.

Referring now to FIG. 5, an operation of the vacuum pump according to the present invention will be described.

FIG. 5 is a vertical sectional view of a turbo molecular pump Pn in which a rotor 16-*n* having rotor blades 17-*n* which have a larger outer diameter Ln than the outer diameter L1 of the rotor blades 17 shown in FIG. 1 is mounted on the rotor shaft 15 shown in FIG. 1. The same members are identified by the same reference numerals shown in FIG. 1 and their detailed description will be omitted. Also, since the composite-type pump mechanism composed of the turbo molecular pump PA and the thread groove pump mechanism portion PB is substantially the same as the conventional vacuum pump, the operation of the pump mechanism will not be described.

As shown in FIG. 5, since the rotor 16-*n* has the rotor blades 17-*n* having the larger outer diameter Ln than the outer diameter L1 of the rotor blades 17 shown in FIG. 1, a larger gap gn is formed between the inner wall of the rotor 16-*n* and the outer wall of the stator column 14, than the gap g1 shown in FIG. 1. To solve this problem, a spacer Sn having a larger diameter than that of the spacer S shown in FIG. 1 is disposed on and fixed to the stator column 14 in this embodiment. More particularly, the spacer Sn has inner-wall shape Sna and outer-wall shape Snb based on the outer-wall shape 14*a* of the stator column 14 and inner-wall shape 16-*na* of the rotor 16-*n*, respectively, and is detachably fixed to the peripheral outer surface of the stator column 14 such that the fixed spacer Sn and the rotor 16-*n* have the predetermined small gap g1 between the outer wall of the fixed spacer Sn and the inner wall of the rotor 16-*n*. Since the spacer Sn is fixed to the peripheral outer surface of the stator column 14 which is stationary during operation of the vacuum pump, the spacer Sn is not displaced by the centrifugal force of the rotating cylindrical body composed of the rotor 16-*n* and the rotor blades 17-*n* and thus always maintains a predetermined gap from the inner wall of the rotor 16-*n*.

Thus, as shown in FIG. 5, the cylindrical rotation body composed of the rotor 16-*n* and the rotor blades 17-*n* under an elevated temperature state caused by the heat of gas compression during operation of the vacuum pump is cooled by feeding a high-thermal-conductivity purging gas such as nitrogen gas (i.e., $N_2$ gas) into the pump case 11 from the outside. More particularly, as FIG. 5 shows the flows of the vacuum-pumping gas and the purging gas indicated by the dotted and solid arrow lines, respectively, the purging gas flows along a passage Rn, which is in communication with the gap between the outer wall of the rotor shaft 15 and the inner wall of the stator column 14 and with the other gap between the outer wall of the spacer Sn and the inner wall of the rotor 16-*n*, and exits from the gas exhaust port 13, thereby the purging gas transferring the heat of gas compression stored in the rotor 16-*n* by conduction from the inner wall of the rotor 16-*n* to the outer wall of the stator column 14 and also to the outer wall of the spacer Sn. With this structure, a thermal boundary layer, which would be formed in the large gap between the outer wall of the stator column 14 and the inner wall of a rotor 16-*n* if the spacer Sn is not disposed in the gap, is not formed in the small gap between the outer wall of the spacer Sn and inner wall of the rotor 16-*n*. Accordingly, the purging gas is prevented from having a lowered thermal conductivity and effectively transfers the heat of gas compression by conduction so as to discharge the heat outside the vacuum pump.

Furthermore, when the rotor 16-*n* having the rotor blades 17-*n* which have the large outer diameter Ln is mounted on the stator column 14 so as to have the predetermined small gap g1 between the inner wall of the rotor 16-*n* and the outer wall of the stator column 14, the rotor 16-*n* is neither required to be formed so as have a thick lower part, nor the stator column 14 accommodating expensive electrical components and the like is required to be manufactured depending on the size of the gap. The only thing to do is to exchange the spacer Sn and fix it to the stator column 14. As a result, a dramatic cost reduction in manufacturing the vacuum pump can be expected in comparison with the manufacturing cost of the conventional vacuum pump.

In the above-described embodiment, in the thread groove pump mechanism portion PB, the outer wall of the rotor 16 is a smooth cylindrical surface and the thread grooves 21 are formed on the inner wall, opposing the cylindrical surface, of the threaded stator 20. Alternatively, the thread grooves 21 may be formed on the outer wall of the lower part of the rotor 16 and the threaded stator 20 may have an inner wall, opposing this outer wall, formed so as to be a smooth cylindrical surface. In this case, the effect of the interaction between the thread grooves 21 on the outer surface of the rotor 16 and the cylindrical surface of the threaded stator 20 can also be expected in the same fashion as that in the above described embodiment.

Although a turbo molecular pump is used in the foregoing embodiments by way of example, the present invention is also applicable to a groove pump and a vortex pump whose structures are well known, in addition, to a molecular pump which is a combination of the turbo molecular pump, the groove pump, and the vortex pump.

As described above in detail, according to the present invention, the vacuum pump has a structure in which a spacer having an inner-wall shape based on an outer-wall shape of the stator column and an outer-wall shape based on the inner-wall shape of the rotor and detachably fixed to the peripheral outer surface of the stator column is detachably fixed to the outer circumferential surface of the stator column. With this structure, a thermal boundary layer is not formed in the gap between the outer wall of the stator column and the inner wall of a rotor. Accordingly, a lowered thermal conductivity can be prevented and effective heat transfer can be achieved. Also even when it is required to form a small predetermined gap between the inner wall of the rotor and the outer wall of the stator column, the rotor is not required to have a thick part, or the expensive stator column is not required to manufactured depending on the size of the gap, but to exchange the spacer only, thereby leading to a dramatic reduction in manufacturing cost of the vacuum pump.

What is claimed is:

1. A vacuum pump comprising:

a pump case having a gas suction port at an upper part of the pump case, a gas exhaust port at a lower part of the pump case, and a base;

a stator column extending from the base of the pump case and having an outer circumferential surface;

a rotor shaft rotatably supported in the pump case by the stator column;

a rotor disposed around the outer circumferential surface of the stator column and integrally connected to the rotor shaft for rotation therewith;

a driving motor disposed in the pump case for rotationally driving the rotor shaft; and a spacer removably integrally connected to the outer circumferential surface of the stator column, the spacer having an outer circumferential surface confronting an inner circumferential surface of the rotor and a radial cut extending from the outer circumferential surface to an inner circumferential surface thereof to define a pair of arm portions; and clamping means for clamping the arm portions of the spacer together to tighten and thereby removably integrally connect the spacer to the outer circumferential surface of the stator column.

2. A vacuum pump according to claim 1; wherein the clamping means comprises a pair of aligned through-holes extending through respective arm portions of the spacer and a connecting member extending in the through-holes.

3. A vacuum pump according to claim 2; wherein the connecting member comprises a bolt.

4. A vacuum pump according to claim 1; wherein the spacer comprises a generally ring-shaped member surrounding the stator column.

5. A vacuum pump according to claim 1; wherein the outer circumferential surface of the spacer has a profile generally conforming to a profile of the inner circumferential surface of the rotor.

6. A vacuum pump according to claim 1; wherein the spacer is disposed between the stator column and the rotor with a preselected gap disposed between the outer circumferential surface of the spacer and the inner circumferential surface of the rotor.

7. A vacuum pump according to claim 1; wherein the spacer is constructed from a high thermal conductivity metal.

8. A vacuum pump according to claim 1; further comprising a plurality of rotor blades fixed to an outer circumferential surface of the rotor and a plurality of stator blades fixed to an inner circumferential surface of the pump case, the rotor blades and the stator blades being alternately disposed.

9. A vacuum pump comprising:

a pump case having a gas suction port at an upper part of the pump case, a gas exhaust port at a lower part of the pump case, and a base;

a stator column extending from the base of the pump case and having an outer circumferential surface;

a rotor shaft rotatably supported in the pump case by the stator column;

a rotor disposed around the outer peripheral surface of the stator column and integrally connected to the rotor shaft for rotation therewith;

a driving motor disposed in the pump case for rotationally driving the rotor shaft; and a spacer removably integrally connected to the outer circumferential surface of the stator column, the spacer having an outer circumferential surface spaced apart from an inner circumferential surface of the rotor and a through-hole extending from the outer circumferential surface to an inner circumferential surface thereof; and a connecting member extending through the through-hole of the spacer and contacting the outer circumferential surface of the stator column to thereby removably integrally connect the spacer to the outer circumferential surface of the stator column.

10. A vacuum pump according to claim 9; wherein the connecting member comprises a setcrew.

11. A vacuum pump according to claim 9; wherein the spacer comprises a generally ring-shaped member surrounding the stator column.

12. A vacuum pump according to claim 9; wherein the outer circumferential surface of the spacer has a profile generally conforming to a profile of the inner circumferential surface of the rotor.

13. A vacuum pump according to claim 9; wherein the spacer is disposed between the stator column and the rotor with a preselected gap disposed between the outer circumferential surface of the spacer and the inner circumferential surface of the rotor.

14. A vacuum pump according to claim 9; wherein the spacer is constructed from a high thermal conductivity metal.

15. A vacuum pump according to claim 9; further comprising a plurality of rotor blades fixed to an outer circumferential surface of the rotor and a plurality of stator blades fixed to an inner circumferential surface of the pump case, the rotor blades and the stator blades being alternately disposed.

16. A vacuum pump comprising:

a pump case having a gas suction port at an upper part of the pump case, a gas exhaust port at a lower part of the pump case, and a base;

a stator column extending from the base of the pump case and having an outer circumferential surface and a portion provided with a through-hole;

a rotor shaft rotatably supported in the pump case by the stator column;

a rotor disposed around the outer peripheral surface of the stator column and integrally connected to the rotor shaft for rotation therewith;

a driving motor disposed in the pump case for rotationally driving the rotor shaft; and a spacer removably integrally connected to the outer circumferential surface of the stator column, the spacer having an outer circumferential surface spaced apart from an inner circumferential surface of the rotor and a step portion extending from the outer circumferential surface of the spacer and having a through-hole disposed in alignment with the through-hole in the portion of the stator column; and a connecting member extending through the aligned through-holes of the spacer and the portion of the stator column to thereby removably integrally connect the spacer to the outer circumferential surface of the stator column.

17. A vacuum pump according to claim 16; wherein the connecting member comprises a bolt.

18. A vacuum pump according to claim 16; wherein the spacer comprises a generally ring-shaped member surrounding the stator column.

19. A vacuum pump according to claim 16; wherein the outer circumferential surface of the spacer has a profile generally conforming to a profile of the inner circumferential surface of the rotor.

20. A vacuum pump according to claim 16; wherein the spacer is disposed between the stator column and the rotor with a preselected gap disposed between the outer circumferential surface of the spacer and the inner circumferential surface of the rotor.

21. A vacuum pump according to claims 16; wherein the spacer is constructed from a high thermal conductivity metal.

22. A vacuum pump according to claim 16; further comprising a plurality of rotor blades fixed to an outer circumferential surface of the rotor and a plurality of stator blades fixed to an inner circumferential surface of the pump case, the rotor blades and the stator blades being alternately disposed.

* * * * *